US006086437A

United States Patent [19]

Murray

[11] Patent Number: 6,086,437

[45] Date of Patent: Jul. 11, 2000

[54] BLOW BACK RUDDER FOR A WATER CRAFT

[75] Inventor: Robert W. Murray, West Palm Beach, Fla.

[73] Assignee: Murray Industries, Inc., West Palm Beach, Fla.

[21] Appl. No.: 09/378,174

[22] Filed: Aug. 20, 1999

[51] Int. Cl.[7] ..... B63H 11/117

[52] U.S. Cl. ..... 440/43; 114/162

[58] Field of Search ..... 114/144 R, 162, 114/163, 164; 440/38, 42, 43

[56] References Cited

U.S. PATENT DOCUMENTS

| | | | |
|---|---|---|---|
| 3,949,700 | 4/1976 | Baroody | 440/43 |
| 3,976,076 | 8/1976 | Eastling | 440/43 |
| 3,982,494 | 9/1976 | Posti | 440/43 |
| 4,779,553 | 10/1988 | Wildhaber, Sr. | 114/144 R |
| 5,167,547 | 12/1992 | Kobayashi et al. | 440/42 |

FOREIGN PATENT DOCUMENTS

| | | | |
|---|---|---|---|
| 283593 | 11/1990 | Japan | 440/43 |

*Primary Examiner*—Jesus D. Sotelo
*Attorney, Agent, or Firm*—Norman Friedland

[57] ABSTRACT

A blow back rudder consisting of a rudder blade, rudder shaft and a plate assembly that is pivotally mounted to the nozzle of a jet nozzle of a personal water craft is spring biased in the steering mode and is positioned out of the water by the impingement force of the jet stream discharging from the nozzle acting on the plate. This provides off throttle steering. The plate is contoured to allow the plate to remain in the jet stream at low thrust and water craft speeds for rudder steering. In another embodiment, these features are contained and the plate is contoured with a concave face and its position relative to the discharge port of the jet nozzle is controlled in order to obtain reversing of the water craft.

12 Claims, 5 Drawing Sheets

BLOW BACK RUDDER FOR A WATER CRAFT

TECHNICAL FIELD

This invention relates to water crafts of the type that utilizes the thrust of water discharging from a nozzle for obtaining movement and steering and particularly to an auxiliary rudder adapted to be utilized solely during slow speeds and/or idle speeds and/or power off (off throttle steering) and/or reversing.

BACKGROUND OF THE INVENTION

As one skilled in this field of technology appreciates, the ability to steer a jet propelled water craft when the throttle is cut and no thrust is being produced by the jet nozzle is non-existence without some type of safety mechanism that allows a rudder to operate during this envelope of the propulsion cycle. There are sun dry mechanisms that have been developed over recent years that are design to provide rudder steering on these types of recreational water craft. These heretofore known devices have not been designed as a safety mechanism to address the problems incidental to off throttle steering, which is essentially the problem that this invention addresses. Obviously, without such a steering device, the water craft is prone to causing accidents since the momentum of the water craft and its inertia caused by the thrust produced by the jet stream of water just prior to being cut will propel the craft in that given direction. For sure, anything in its way will meet with some type of catastrophe. Since these water crafts are particularly desirable for recreational purposes, the mechanism that is designed to provide this auxiliary steering must be simple and not interfere with the handling of the craft. For example, if the auxiliary steering mechanism remains in the water and produces drag, the drag would adversely affect the handling of the craft and in some instances create a hazard by not allowing the water craft to slide sideways but rather causes the water craft to roll over throwing the operator from the craft. This obviously detracts from the water craft's ability to produce the maneuvering desirable. Several of the devices that have attempted to solve this problem are detailed in the prior art and are discussed below.

U.S. Pat. No. 3,976,026 granted to Eastling on Aug. 24, 1976 entitled "Slow Speed Steering Control for Jet-Powered Water Craft" shows a steering plate (rudder) mounted below the exhaust port of a jet propelled water craft. While it includes a spring biased rudder, the rudder remains in the water below the exhaust port at all times and the spring serves to allow the rudder to displace slightly upward upon hitting a foreign objects. Unlike the present invention the rudder remains in the water at all times below the exhaust port and the stream of flow discharging therefrom.

Another example of an auxiliary rudder is disclosed in U.S. Pat. No. 3,982,494 granted to Posti on Sep. 28, 1976. The rudder for this jet powered water craft is in fact a twin rudder parallelly mounted adjacent the outer periphery of the jet nozzle. A piston responding to the velocity in the jet stream mounted within the nozzle serves to raise the twin rudder above the nozzle and out of the water. While it is intended to provide a similar function as that being provided by the present invention, it is complicated and requires a motive force by virtue of the piston to actuate the rudder. Another draw back to this design is that the rudder has to overcome the force of the piston to be raised in the event that the rudder hits a foreign object. Notwithstanding that the force on the piston is relieved to allow the rudder to drop into the water in its operative position, it still must overcome whatever force is being sensed by the piston while in a slow moving mode. Obviously, when the throttle is full off, the force is removed and presumably the rudder will lift in the event it meets a foreign object.

U.S. Pat. No. 4,779,553 granted to Wildhaber, Sr. on Oct. 25, 1988 entitled "Automatic Rudder for Outboard Jet Motors" exemplifies still another embodiment of an auxiliary rudder intended to operated during the low speed and/or power-off mode of operation. In this embodiment the rudder is pivotally mounted to a base that fits over the steering nozzle and bolted thereto and is configured to drop by virtue of gravity when the plume from the jet nozzle decays or ceases. The engine is an outboard motor whose propulsion portion is fully emersed in the water. The rudder in this structure is always remains in the water and is never raised out of the water.

U.S. Pat. No. 5,167,547 granted to Kobyashi et al on Dec. 1, 1992 entitled "Rudder For Watercraft" discloses an auxiliary rudder designed for a water jet propelled water craft the includes a control for removing the rudder out of the water during high speed operations and includes a spring bias that allows the rudder to be displaced upon hitting a foreign object. It doesn't utilize a plate or disk to activate the rudder as is disclosed in the present invention.

The problems with the prior art auxiliary rudders is that the mechanism is either too complex, doesn't exit the water while not in use, or doesn't have the force capability to properly position the rudder, or is too slow in its deployment. Aside from the mechanical differences and differences in design philosophy, these prior art devices just described do not have as its primary objective the safety of the operator and/or occupants as is the case of the present invention.

This invention is particularly related to the throw back rudder; i.e. the type of rudder that is forced out of the water by the force of the water stream discharging from the jet nozzle of the water craft. I have found that I can obviate the problems noted above by designing the rudder to be biased in the downward position by a spring and including a plate-like member that substantially fits or is contiguous with the jet nozzle port when the rudder is deployed. The rudder is mounted to the jet nozzle and rotates therewith for providing the steering and is located downstream of the jet nozzle. The plate-like portion's relative position with respect to the nozzle's exhaust port is that it lies in line therewith and virtually covers the port so that the jet stream impinges the plate and blows back the rudder out of the path of the jet stream. The rudder is in coincidence with the center line of the jet nozzle's exhaust port to assure accuracy in the steering. It is contemplated that the edge of the plate can be contoured so that it provides a space between the wall of the exhaust port to define an opening to allow for a given amount of the flow stream to penetrate therethrough for allowing the rudder to be deployed in the steering mode at low speeds. The area of the gap defined by this contour determines the speed at which the rudder is deployed. In another embodiment of this invention the plate-like member is contoured with a concave surface facing the jet stream discharging from the jet nozzle so as to reverse the flow of the jet stream and cause reversing of the water craft. Essentially, other than the reversing feature, this embodiment provides all of the features that are provided by the embodiment described in the immediate above paragraphs.

My invention is characterized as being simple to fabricate, install, maintain, is reliable and will almost instantly deploy in the steering position without incuring any delays in the transition from the non-deployment to the deployment positions. This has the advantage of affording a safety factor to the rider and/or occupants inasmuch as it prevents accidents and hence, eliminates blunt force trauma that is the cause of fatalities and the concern in the industry.

SUMMARY OF THE INVENTION

On object of this invention is to provide an auxiliary rudder for a jet powered water craft that is normally biased toward the operating steering condition and is raised out of the water during the water crafts normal operation and provides off throttle steering immediately. A plate attached to the rudder shaft and located adjacent to the discharge port of the jet nozzle forces the rudder up and out of the water by virtue of the impingement force of the jet stream on the plate. This embodiment has the option of contouring the edge of the plate to permit a regulated amount of flow therebetween for allowing the rudder to become deployed at low operating speeds of the water craft so as to operate in the steering mode under these low speed conditions. In another embodiment the plate mounted on the rudder shaft may be configured to a concave shaped face that when deployed in the reversing mode causes the jet stream produced by the jet motor to reverse directions so that the thrust causes the water craft to reverse. A locking cable affixed to the plate and a reversing lever is activated to a locked position upon movement of the lever so as to lock the plate and allow for the positioning of the plate by the movement of the lever to hold it in the exhaust of the jet nozzle to obtain reversing of the water craft. The existing lever and cables that are utilized for ancillary purposes on many models of these personal water crafts can be adapted for use in this invention for effectuating the reversing mode.

This invention is characterized as being simple to fabricate, capable of being added to existing power jet water craft, is economical and easy to install. The invention also provides improved transition time in positioning the rudder into the water for immediate steering capabilities and provide safety to the users of these personal water crafts.

The foregoing and other features of the present invention will become more apparent from the following description and accompanying drawings.

BRIEF DESCRIPTION OF THE DRAWINGS

FIG. 1 is a partial view in perspective illustrating the details of the invention;

Figure 1:
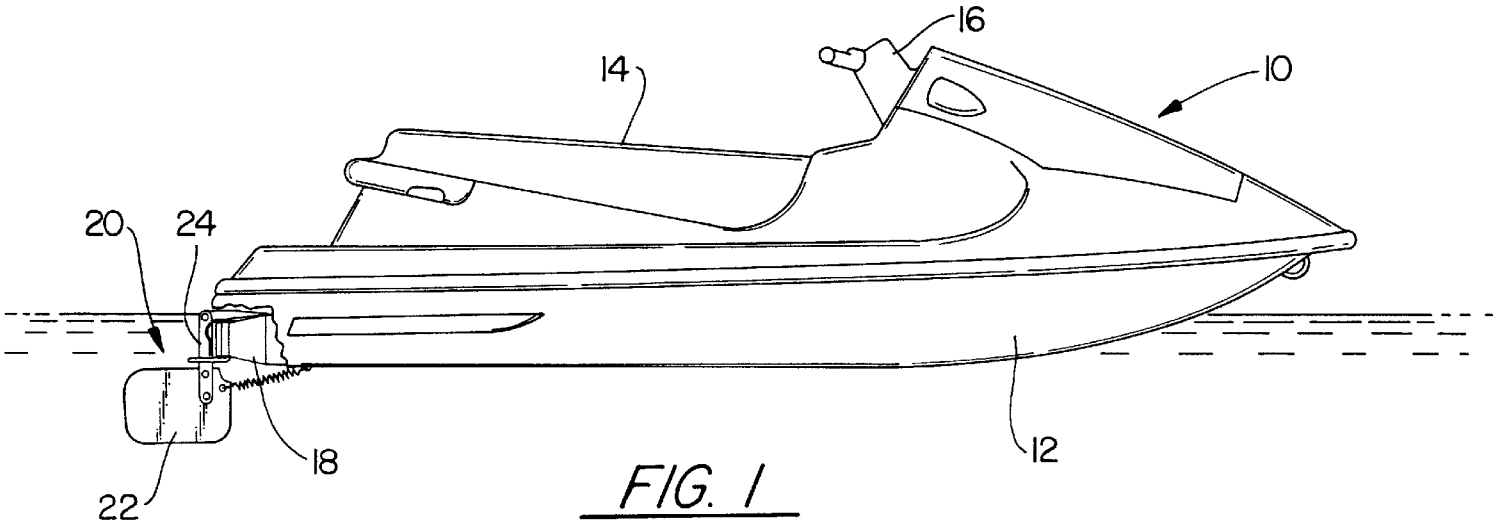
FIG. 1 is a perspective view in elevation of a jet powered water craft with the present invention illustrating the auxiliary rudder deployed in the water for the steering mode.
Figure 2:
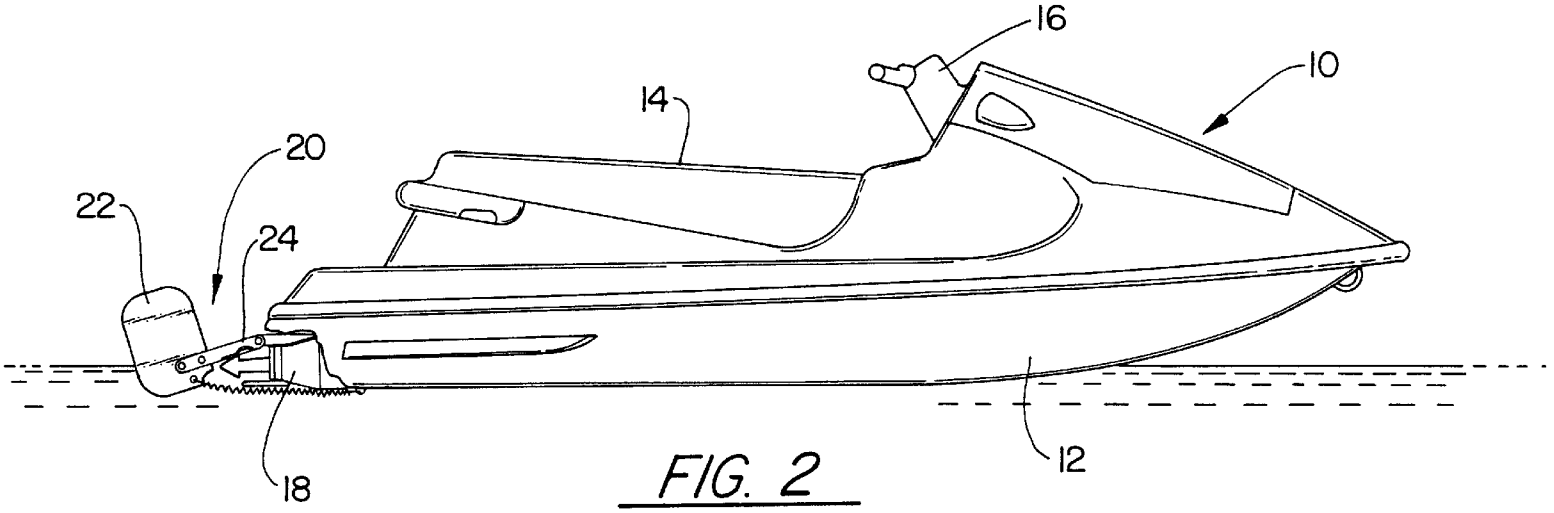
FIG. 2 is a perspective view in elevation identical to the embodiment in FIG. 1 illustrating the auxiliary rudder out of the steering mode.

These figures merely serve to further clarify and illustrate the present invention and are not intended to limit the scope thereof

DETAILED DESCRIPTION OF THE INVENTION

While this invention is especially efficacious for the types of personal water crafts that are known in the industry such as "Jet Skies", "Sea Doos" etc., as one skilled in this art will appreciate this invention would have utility to other types of crafts that utilize a stream of water to produce thrust.

Referring now to the invention which is best seen in FIGS. 1 through 6 which illustrate a jet powered water craft generally illustrated as reference numeral 10, having a hull 12, seats 14, a steering mechanism or handle bar 16 suitably connected to the movable jet nozzle 18 which attaches to the discharge end of a suitable motor (not shown).Typically, the only steering that one can do on these commercially available recreational water crafts is by rotating the jet nozzle 18 from side to side to direct the jet stream produced by the engine in the direction to produce turning of the water craft. The movable jet nozzle is the sole mechanism for steering the water craft. As is known, the rotation of the steering handle 16 rotates the jet nozzle 18 an appropriate amount to turn the water craft into the steered direction, otherwise the water craft is normally propelled in the forward direction. Some of the water crafts include a reversing mechanism that reverses the direction of the water stream in order to reverse the water craft's direction. As mentioned above, this invention serves as an auxiliary rudder, i.e a rudder blade that serves as either the sole steering mechanism when the jet stream no longer is being produced by the engine or becomes an augmented steering mechanism when the motor is producing a low thrust during low speed operations. Hence, the present invention provides power off and low power rudder control without interfering with the normal power operation of the water craft. In another embodiment the present invention offers all of the above and in addition reversing capabilities that will be described herein below.

In accordance with this invention an auxiliary rudder and its control mechanism generally illustrated by reference numeral 20 consists of the rudder blade 22 preferably made from a suitable light weight material such as "lexan", a rudder shaft 24 supporting the rudder blade 22 by suitable nut and bolt assemblies 26 at one end and a support bracket 28 affixed to the jet nozzle 16 housing 30 so as to rotate therewith. The rudder blade 22 is pivotally affixed to the end of support bracket by the nut and bolt assembly 31 so as to be easily raised and lowered as will be described in more detail hereinbelow. The support bracket 28 is attached to the jet nozzle 18 housing 30 by extending the existing stainless steel sleeve 32 that supports the jet nozzle 18 and bolting it by the nut and bolt assembly 33 to the support bracket 28. The support bracket 24 extends toward the bow of the water craft and is affixed to the nozzle housing 30 by the nut and bolt assembly 38 at a point remote from the discharge port 40 of the jet nozzle 16 and where the steering cable (not shown) that is controlled by the handle bar 16 is attached. It is apparent from the foregoing that this assembly assures that the rudder blade rotates with the jet nozzle 18 and is aligned therewith and that it bisects the exhaust port 40. The rudder blade 22 is capable of pivoting upwardly when the jet stream discharging from the exhaust nozzle is at and above a given velocity and pivots downwardly when the velocity decays or ceases.

A guide post or a pair of guide arms 42 are affixed at the stern of the water craft and define a space 44 for receiving the rudder blade 22. The purpose of these guide arms is to secure the rudder blade 22 when it is in the steering position to react the loads that the rudder blade 22 encounters during steering of the water craft. The outer ends of the guide arms are bent outwardly to define a ramp for ease of guiding the rudder blade into the space 44.

One end of coil spring 46 attaches to the rudder blade 22 at the drilled hole 48 which is a location relative to the pivot point where there is sufficient moment arm so as to easily be deployed when the load produced the jet stream is lessened as will be described herein below. The other end of the coil spring 46 is anchored to clamp 50 that attaches to the water craft by the existing intake assembly bolts of the jet nozzle 16 located at the stem of the water craft. The spring 46, which preferable is made from stainless steel, is in tension to bias the rudder blade 24 in the down or steering position when the power is off, or the engine is at idle or the water craft is at low speeds.

The raising of the rudder blade 24 is by virtue of the impingement disk or plate 56 that is suitably attached to the rudder shaft 24, say by welding and is located in proximity to the discharge port 40 of jet nozzle 18 when the rudder plate is in the down position. The face 58 of plate 56 is generally flat and is dimensioned to be contiguous with the port of the jet nozzle 18. The lip 62 of the plate 56 may be configured or bent outwardly relative to the discharge port 40 so as to leave a slight gap for the jet stream to flow thereby.

This allows for the rudder to be deployed while the water craft is operating at a low speed. Preferably diametrically opposed edges of the plate 56 are similarly configured to balance the load on plate 56 and provide balanced thrust developed by the engine (see FIG. 4 where the flow is depicted by arrows A). Preferably the plate 56 is located as close to the discharge port 40 or for that matter can be made to fit therein.

Figure 3:
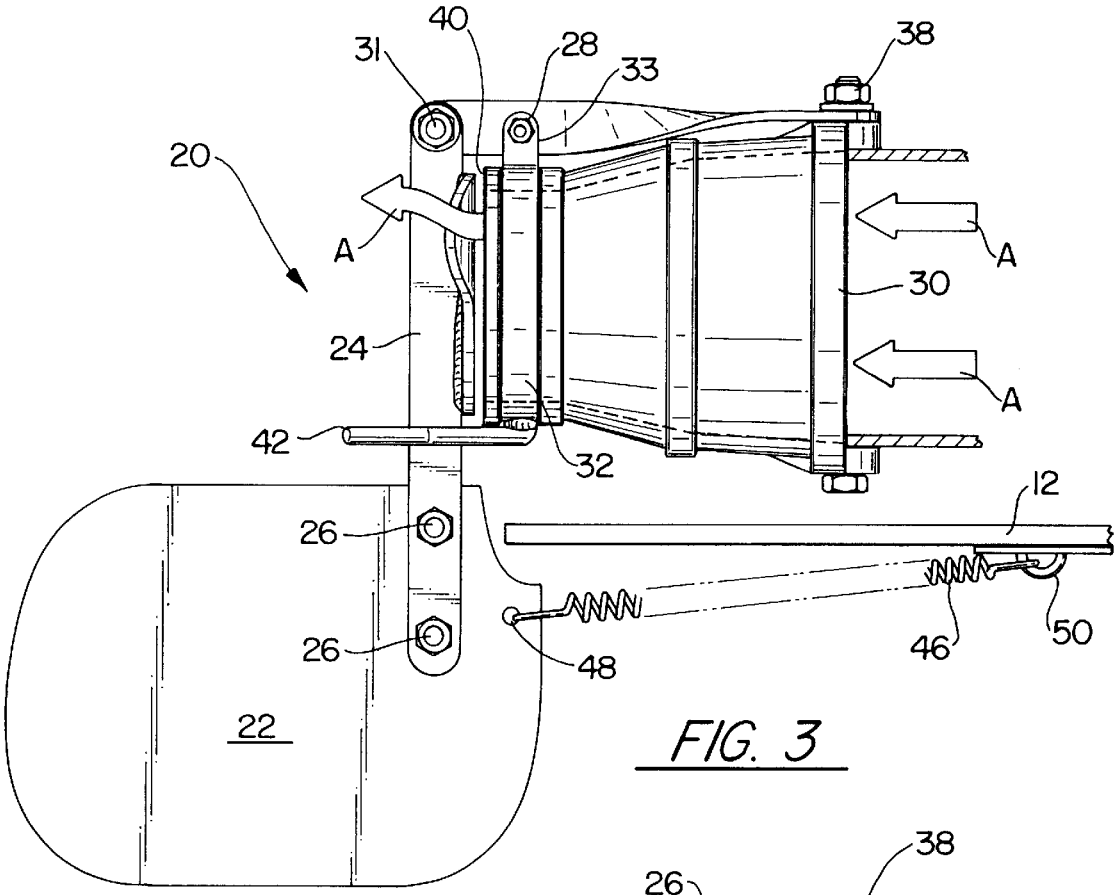
Figure 4:
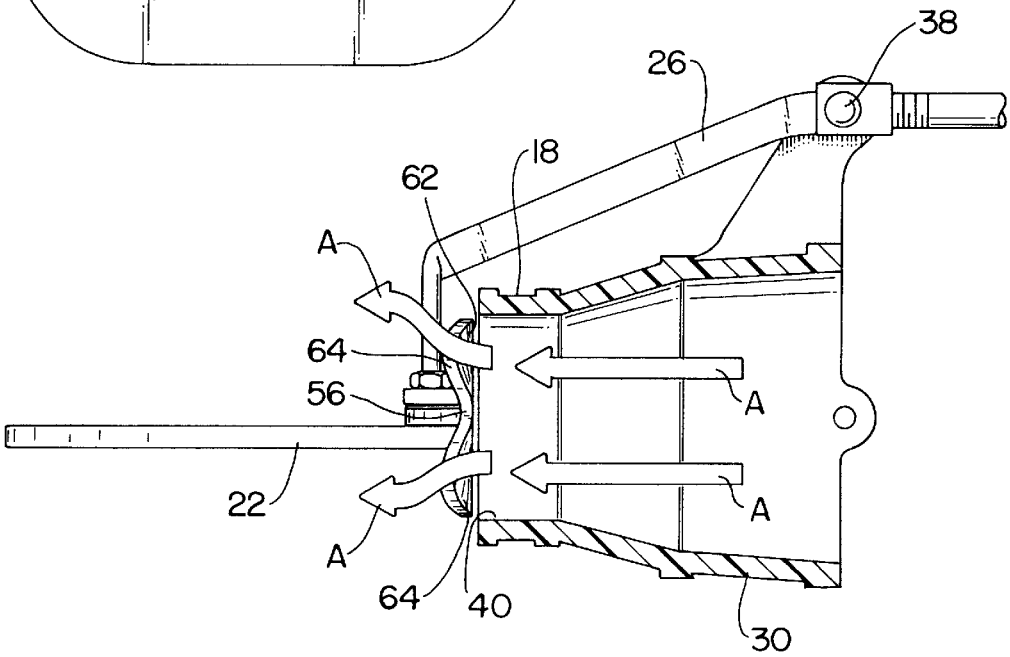
FIG. 4 is a partial view partly in section illustrating the details of the invention when the water craft is operating at low speeds and the auxiliary rudder is in the steering mode.
Figure 5:
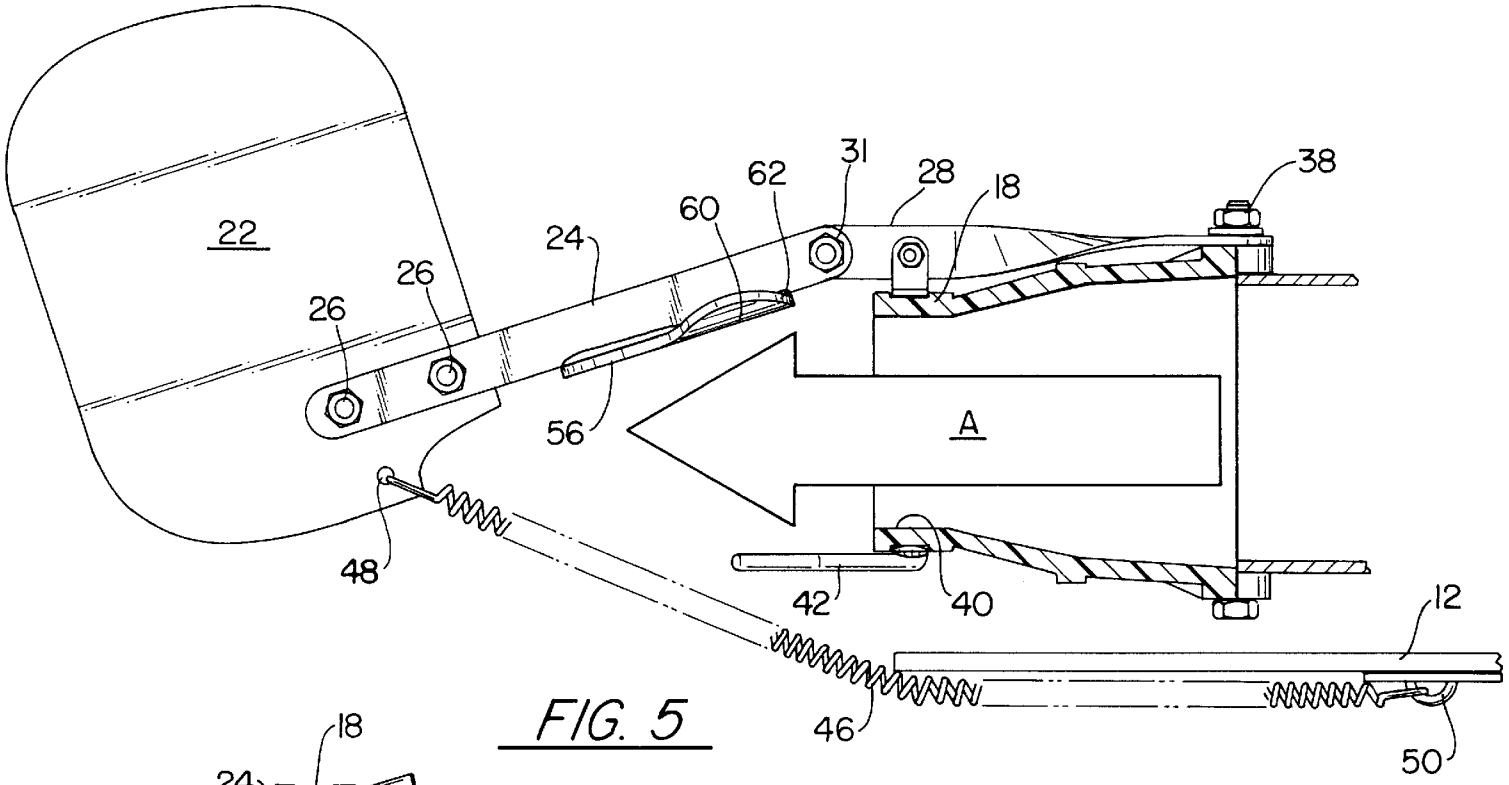
FIG. 5 is a view similar to FIG. 4 with the auxiliary rudder in the no-steering mode.
Figure 6:
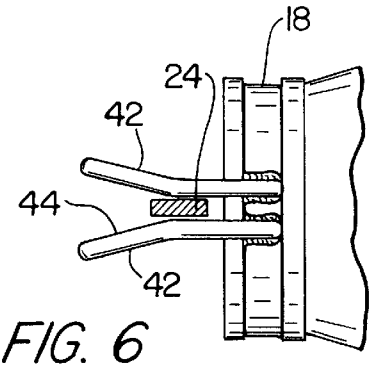
FIG. 6 is a fragmentary plan view of the guide for the rudder of this invention.

In operation as best seen by FIGS. 3 and 5, the rudder is held out of its steering mode (FIG. 5) by virtue of the jet stream impinging on the plate 56 forcing the rudder blade 22 upwardly and out of or partially out of the water. In this mode the spring 46 is fully extended and its stored energy bias the rudder blade 22 in the downward direction. When the stream decreases in velocity the force of spring forces the rudder blade 22 in the downward direction, it pivoting about the pivot 31 (see FIG. 3). When the rudder blade 22 is fully deployed a portion thereof will be guided in the space 44 between the guide arms 42. Obviously, owing to the tension of spring 46, the motion of the rudder blade 22 in the downward direction is substantially instantaneous. This provides a fast and smooth transition from the non-steering mode to the steering mode of the rudder.

Figure 7:
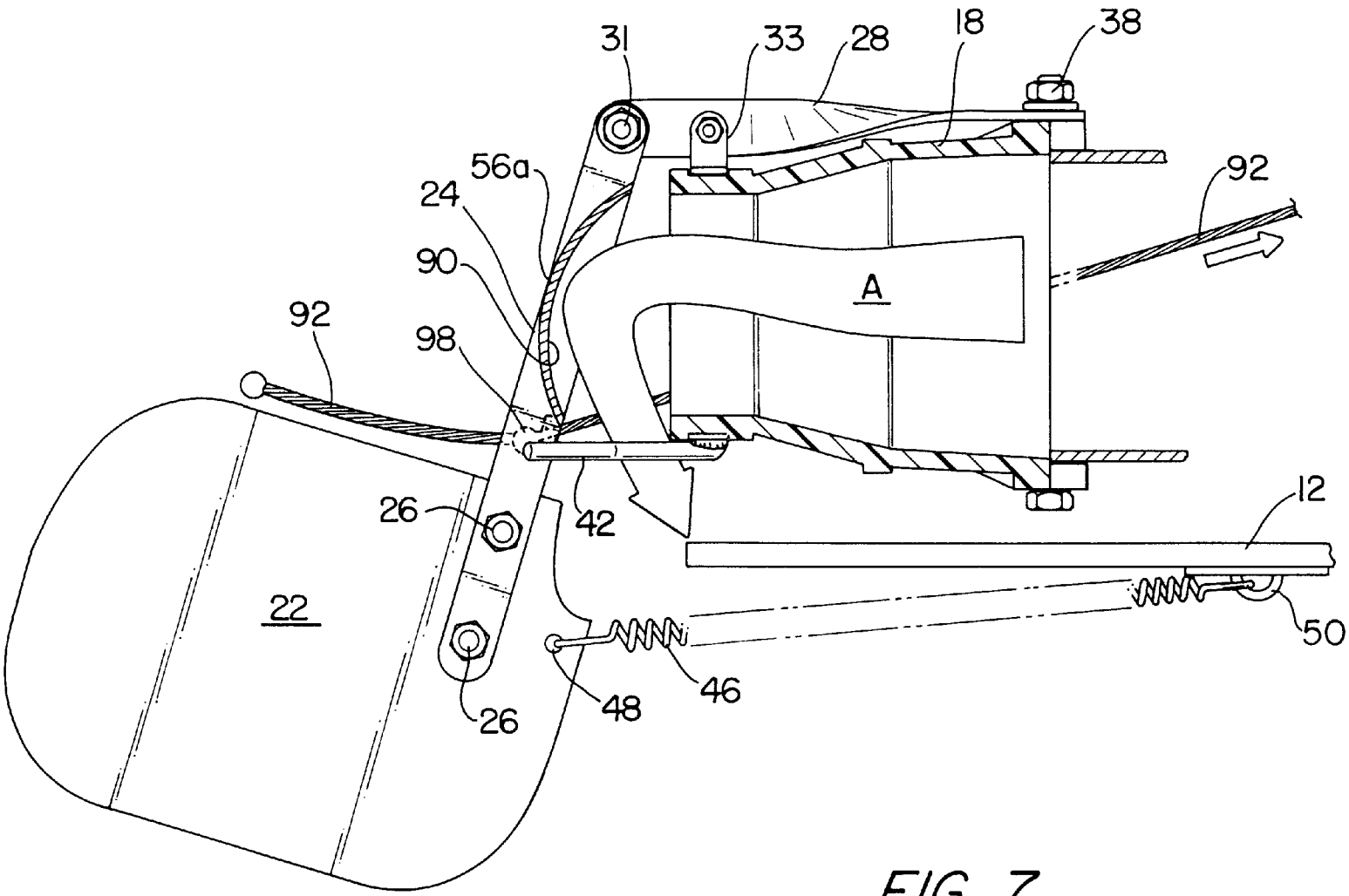
FIG. 7 exemplifies another embodiment of this invention that replaces the flat-plate element with a dish or spoon shaped element to obtain reversing and shows the operating mode when the reversing is not actuated.
Figure 8:
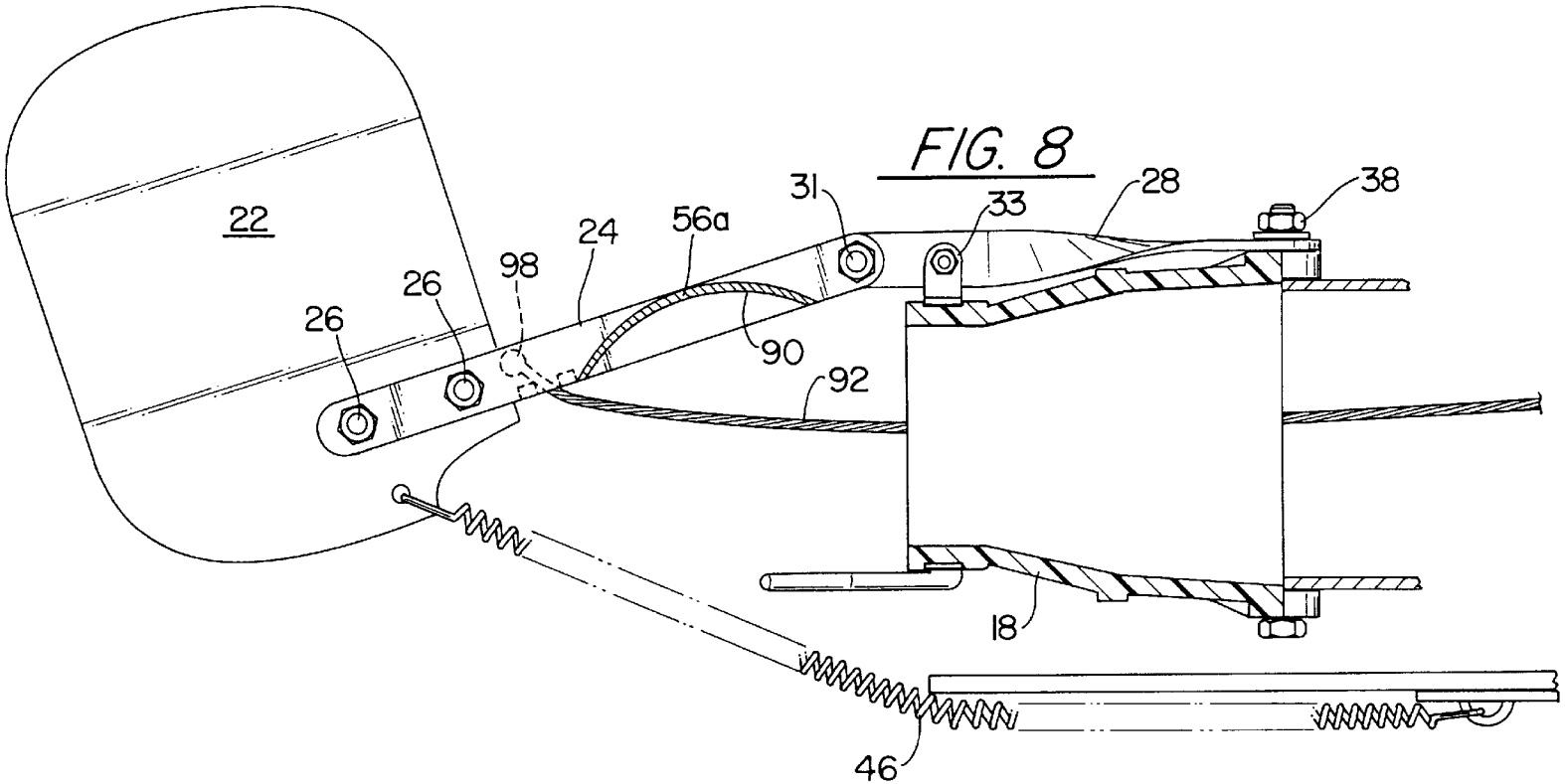
FIG. 8 is a view of the embodiment depicted in FIG. 7 with the auxiliary rudder placed in the non-steering mode.
Figure 9:
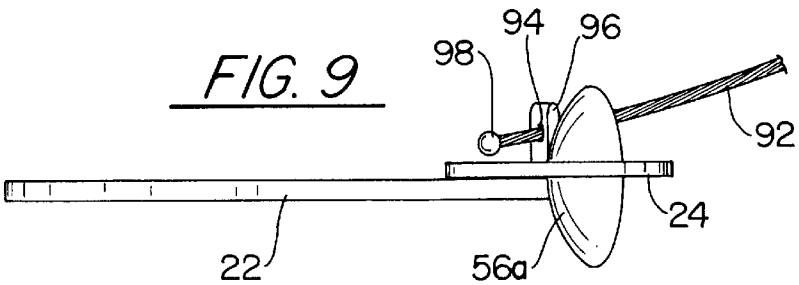
FIG. 9 is a perspective fragmentary view showing the details of the reversing cable and its connection.

FIGS. 7, 8 and 9 depict another embodiment of this invention and the reference numerals depicting various elements are the same for similar elements in all of the FIGS. The principal difference between this embodiment and the embodiment described in FIGS. 1–6 is the plate 56 which is configured to cause the jet stream to be reversed so as to place the water craft in reverse. Plate 56*a* is contoured in the shape of a spoon where the face 90 facing the jet stream A is concave to force the jet stream to reverse direction. The rudder blade is activated in the deployed position by virtue of the cable 92 which may be attached to the throttle lever of the existing throttle or to a separate reversing lever. The other end of the cable is fitted into the hole 94 formed in the boss or upstanding projection 96 affixed to the shaft 24. A ball or projection 98 formed on the end of cable 92 abuts against the face of the boss 96 and forces the rudder blade 22 downwardly in the reverse deployed position. In the reverse deployed position the length of cable and movement of the lever will position the plate 56*a* to be spaced from the discharge port a sufficient distance to allow the jet exhaust to impinge on the face 90 and make a 180 degree (°) turn and flow by the nozzle housing 30. The lever will lock so as to keep the rudder in position during this steering mode of the reversing operation. The hole 94 is made slightly larger in diameter than the diameter of cable 92. This obviously, allows the cable to slide through the hole and not affect the rudder plate 22 when the reversing is not in operation.

What has been shown by this invention is a simple, yet efficacious auxiliary rudder, that in one of the embodiment has reversing capabilities. By virtue of the spring biasing the deployment of the rudder is substantially instantaneous. The rudder can be installed in original or existing water craft, requiring few parts, is relatively inexpensive, and highly reliable. Usage of this invention has shown to provide instant control of the water craft. Test have shown that almost inantaneously the rudder will produce drag and the water craft will almost instantaneously respond to the steering which would help to prevent accidents, which would otherwise be imminent without the use of the auxiliary rudders of the present invention. This invention is particularly efficacious for preventing the blunt force trauma that was described above.

Although this invention has been shown and described with respect to detailed embodiments thereof, it will be appreciated and understood by those skilled in the art that various changes in form and detail thereof may be made without departing from the spirit and scope of the claimed invention.

I claim:

1. An auxiliary rudder assembly for a personal water craft powered by an engine having a pivotal nozzle for producing a water stream for obtaining thrust for propelling and steering of the water craft, said nozzle having an exhaust port said rudder assembly including a rudder shaft pivotally mounted to the nozzle and movable therewith, a rudder blade attached to one end of said rudder shaft and movable therewith, a plate attached to said rudder shaft and disposed adjacent to said exhaust port when in the deployed position and pivoting said rudder shaft and rudder blade away from said exhaust port and out of said water stream in the non-deployed position such that said rudder blade is out of the water, and a spring attached to said rudder assembly and said water craft for positioning said rudder blade into the water when the velocity of said water stream ceases or decays whereby said rudder blade is deployed in the steering mode.

2. An auxiliary rudder assembly for a personal water craft powered by an engine having a pivotal nozzle for producing a water stream for obtaining thrust for propelling and steering of the water craft as claimed in claim 1 including a support bracket affixed to the top of said nozzle and having one end attached thereto and extending above and beyone said port, one end of said rudder shaft affixed to the opposite end of said support bracket for being moved into and out of the water, said rudder shaft bisecting said port so as to be aligned with the central axis of said port.

3. An auxiliary rudder assembly for a personal water craft powered by an engine having a pivotal nozzle for producing a water stream for obtaining thrust for propelling and steering of the water craft as claimed in claim 2 wherein said spring is a coil spring and one end is attached to said rudder blade at a location that is off-center from the axis of said rudder blade.

4. An auxiliary rudder assembly for a personal water craft powered by an engine having a pivotal nozzle for producing a water stream for obtaining thrust for propelling and steering of the water craft as claimed in claim 3 including a guide attached to said nozzle and movable therewith for supporting said rudder when in the deployed position.

5. An auxiliary rudder assembly for a personal water craft powered by an engine having a pivotal nozzle for producing a water stream for obtaining thrust for propelling and steering of the water craft as claimed in claim 4 wherein said plate includes an outer rim and a portion of said outer rim is contoured away from said exhaust port to define an opening between said plate and said exhaust port to permit the flow of the jet stream when said rudder blade is deployed to allow said auxilliary rudder to steer the wate craft at low speeds of the water craft.

6. An auxiliary rudder assembly for a personal water craft powered by an engine having a pivotal nozzle for producing a water stream for obtaining thrust for propelling and steering of the water craft as claimed in claim 5 wherein said plate includes two diametrically opposed contoured tip portions for permitting the flow from said exhaust port when the rudder blade is in the deployed position.

7. An auxiliary rudder assembly for a personal water craft powered by an engine having a pivotal nozzle for producing a water stream for obtaining thrust for propelling and steering of the water craft, said nozzle having an exhaust port, said rudder assembly including a support bracket affixed to the top of said nozzle and having one end attached thereto and extending above and beyond said exhaust port, a rudder shaft affixed to said one end of said support bracket for being moved into and out of the water, said rudder shaft bisecting said exhaust port so as to be aligned with the central axis of said exhaust port, a rudder blade attached to one end of said rudder shaft and movable therewith, a plate attached to said rudder shaft and disposed adjacent to said exhaust port when in the deployed position and forcing said rudder shaft and rudder blade away from said exhaust port by the jet stream impinging thereon and out of said water stream in the non-deployed position such that said rudder blade is out of the water, a spring operatively connected to said rudder assembly for positioning said rudder blade into the water when the velocity of said water stream ceases or decays whereby said rudder blade is deployed in the steering mode, and a guide attached to said nozzle and movable therewith for supporting said rudder when in the deployed position.

8. An auxiliary rudder assembly for a personal water craft powered by an engine having a pivotal nozzle for producing a water stream for obtaining thrust for propelling and steering of the water craft, said nozzle having an exhaust port, said rudder assembly having reversing capablilities and including a rudder shaft pivotally mounted to the nozzle and movable therewith, a rudder blade attached to one end of said rudder shaft and movable therewith, a plate attached to said rudder shaft and disposed adjacent to said exhaust port when in the deployed position and pivoting said rudder shaft and rudder blade away from said exhaust port and out of said water stream in the non-deployed position such that said rudder blade is out of the water, and a spring attached to said rudder assembly and said water craft for positioning said rudder blade into the water when the velocity of said water stream ceases or decays whereby said rudder blade is deployed in the steering mode, said plate having a covex face substantially contiguous with said exhaust port for reversing the flow of the jet stream to cause said water craft to reverse, a lever available to the operator and a cable attached to said lever and said rudder assembly to move said plate in a spaced relationship to said exhaust port to permit said jet stream to impinge on said concave face and discharge away from said exhaust port said rudder assembly moveable relative to said cable when said reverseing mode is deactivated.

9. An auxiliary rudder assembly for a personal water craft as claimed in claim 8 including a projection extending from said rudder shaft, a hole in said projection permitting the cable to pass there through and a wider diameter on the end of said cable to abut against said rudder shaft to cause said plate to move toward said exhaust port in the exhaust mode.

10. An auxiliary rudder assembly for a personal water craft as claimed in claim 9 including a support bracket affixed to the top of said nozzle and having one end attached thereto and extending above and beyond said exhasut port, one end of said rudder shaft affixed to the opposite end of said support bracket for being moved into and out of the water, said rudder shaft bisecting said exhaust port so as to be aligned with the central axis of said exhasut port.

11. An auxiliary rudder assembly for a personal water craft as claimed in claim 10 wherein said spring is a coil spring and one end is attached to said rudder blade at a location that is off-center from the axis of said rudder blade.

12. An auxiliary rudder assembly for a personal water craft as claimed in claim 11 including a guide attached to said nozzle and movable therewith for supporting said rudder blade when in the deployed position.

* * * * *